US005742115A

United States Patent [19]

Gertsenshteyn

[11] Patent Number: 5,742,115

[45] Date of Patent: Apr. 21, 1998

[54] COLOR IMAGE INTENSIFIER DEVICE AND METHOD FOR PRODUCING SAME

[75] Inventor: Michael Gertsenshteyn, Jerusalem, Israel

[73] Assignee: Orlil Ltd., Kazrin, Israel

[21] Appl. No.: 663,698

[22] Filed: Jun. 14, 1996

[30] Foreign Application Priority Data

Jun. 15, 1995 [IL] Israel ..... 114181

[51] Int. Cl.[6] ..... H01J 40/16; H01J 31/50

[52] U.S. Cl. ..... 313/365; 313/524; 313/526

[58] Field of Search ..... 313/365, 524, 313/526, 525, 527, 528, 530, 478, 373; 250/214 VT

[56] References Cited

U.S. PATENT DOCUMENTS

| | | | |
|---|---|---|---|
| 4,374,325 | 2/1983 | Howorth | 313/524 |
| 5,233,183 | 8/1993 | Field | 250/214 VT |

OTHER PUBLICATIONS

Hans Funk et al., Low Light Level Color Camera with One CCD, pp. 72–80, SPIE vol. 1243 Electron Image Tubes and Image Intensifiers, Dec. 1990.

Image and Camera Tubes Electric–Optics Handbook Section 11, pp. 173–181.

Detector Characteristics Electro–Optics Handbook, pp. 155–157.

*Primary Examiner*—Ashok Patel

*Assistant Examiner*—Jay M. Patidar

*Attorney, Agent, or Firm*—Lowe, Price, LeBlanc & Becker

[57] ABSTRACT

A color image intensifier device includes an evacuated envelope with an input window for receiving incident light from the environment. A photocathode is deposited upon the interior surface of the envelope of the input window for converting the incident light into a photoelectron signal. A phosphor layer, emitting several wavelengths approximating white light when struck by and amplified by an intensified photoelectron signal, is deposited upon an interior surface of the envelope proximate an output window to convert the amplified signal into a visible light output image projected from the intensifier.

13 Claims, 5 Drawing Sheets

COLOR IMAGE INTENSIFIER DEVICE AND METHOD FOR PRODUCING SAME

FIELD OF THE INVENTION

The present invention relates to an image intensifier device and to a method for producing the same, and more specifically to an image intensifier having a real color output image and which uses coloring doped glass elements in input and output windows of image intensifier.

BACKGROUND OF THE INVENTION

An image intensifier (often called in the literature an "imaging tube" or an "image-converting tube") for intensifying low light level visible images or converting images from nonvisible (ultraviolet or infrared) regions of optical spectrum into higher intensity visible display is well known. For example, image intensifiers for many decades, have been traditional military night-using equipment such as "night vision goggles". A variety of different image intensifier types exists. One most popular design employs a fiber optic input window through which a desirable image from the environment is received into an evacuated intensifier tube envelope. A photon-to-photoelectron converting substance, such as an antimony—multi-alkali compound, forms a photocathode layer on the interior face of the input window. Examples of typical substances and image intensifier operations are described in the "Electro-Optics Handbook" published by Burle Industries, Inc., Tube Produce Division (1989), Chapters 10 and 11. Light from the image focused upon the fiber optic input window traveling through it, strikes the photocathode, which emitted the photo electrons in proportion to the magnitude of the incident light. After emission, photo electrons are accelerated and amplified by passage through high field spacings and microchannel plate.

An amplified flux of electrons hits a phosphorescent member typically zinc cadmium sulfide:silver compound deposited upon an output screen or window and produces a final intensified light signal. Because of the high field and small spacing between the cathode and microchannel plate (therein after called MCP) as well as between the MCP and the phosphor screen, photo electrons do not deviate much from trajectories that are parallel to the tube's axis.

It has been found that fiberoptic output windows preserve image resolution. The input window and the output window typically constitute the end caps of the vacuum envelope which contains the photocathode, microchannel plate and phosphor screen therein.

Image intensification devices of this kind are generally insensitive to color—that is to say the image intensifier enhances only the intensity of a received image, and if a color image is presented to it the color content of the image is lost. It is obvious that to view an image having color is much more preferable to the human eye, because of the color nature of human vision and all image composition identification or pattern recognition based on color vision. Moreover, it is possible that image and background of different colors but with equal radiation intensity will produce equal output contrast on the monocolor (usually green) screen of the image intensifier. For example, if a green object and its deep-red background have the same light intensity, the green object will not be visible through a conventional image intensifier. As a result a considerable amount of information is lost which could otherwise be obtained from a colored image.

The need for color image intensifiers is very comprehensive. There are at least several applications already requiring color image intensifications. First of all when a color format is preferred (as in TV news reporting), when colors are required for identification of an object, when the illumination contrast is poor, but the color contrast, characterized by maximum difference in the colors of the object, is good. Following is a list of the basic occurrences when a color image intensifier is desirable:

- Professional and amateur user color tele-photo cameras (for low light level television and home video markets);
- Medical endoscope imaging;
- Imaging for microsurgery;
- Astronomic imaging;
- Infrared and ultraviolet conversion (for real time product inspection or pollution surveying);
- Night surveillance devices.

It is a known technique for producing color image intensification on a base of the conventional imaging tube (except by using white light fluorescing phosphor instead of a monocolor one). For example applying narrow stripe three-color filters directly to the external surface of a fiber optic faceplate and alignment to it of the same stripe three-color filters in fiber optic output in the operating tube will produce a color image, as was described in the U.S. Pat. No. 4,374,325. For analysis of this method as well as several difficulties which cause it to deteriorate see test "Low Light Level Color Camera with One CCD (Charge Coupled Devices)", SPIE Electron Image Tubes and Image Intensifiers, 1990. It is very difficult to have good alignment and registration between the stripe filters at the output of image intensifier with the stripe filters at the intensifier input. The input filter set, must have precise stripe spacing and angle with respect to the output filter set. Any distortion in the tube or fiber optical coupler results in bad alignment and registration between the input filter stripes and stripes of the output filter which produces alias patterns and bad color. Gross and micro-distortions in the fibers and fiber optic arrays and exact position and orientation of the components within the fiberoptic array cannot be known for cascaded fiberoptics until a system has been fabricated.

It is, nevertheless, at least one method for generating color output images where an input color filter set is aligned with an output color filter set in an image intensifier. Such methods are described in the U.S. Pat. No. 5,233,183. The patent relates to an image intensifier tube with input matrix of red, green and blue filters printed upon a thin glass wafer and sandwiched between the faceplate and named thin glass wafer on which photocathode has been deposited afterwards. The intensifier is then assembled and placed in a darkened chamber where a matrix of red output filters is fabricating by positioning of red photosensitive coloring material proximate to the output fiber optic, exposing of it by output image from a working intensifier whose input window is bathed in red light, and developing photosensitive material. Serial repeating of this operation for green and blue types of material yields a plurality of coloring elements aligned to the plurality of input elements. A protective from physical damage coating of a clear lacquer may be applied over the output color filter elements.

There are several difficulties with this method such as the possibility of bad matching of the input matrix of color filters and fibers or fiber optic arrays in the output window which can cause cross talk between filters of different colors in a process of exposure and development of photosensitive coloring materials, presence of a glass wafer between input color filters and photocathode which leads to the blurring of the color proportional to the thickness of the wafer and reduces input window transparency because of multi reflectance in multilayered structure faceplate—filter—glass wafer, protective clear coating of output color filters which interferes with fiber optics coupling to CCD or other devices and sensitively reduce the field of application of the color intensifier. Another difficulty is the need of a great number of additional to conventional colorless tube production operations necessary for producing a color device, such as bonding of thin glass wafer with input filters to the faceplate in a way where filters are sandwiched between the faceplate and the glass wafer and a big number of serial operations in additional darkened chamber for dispensing, exposure, wet developing and disposing of non exposed photosensitive coloring materials for red, green and blue filters.

It is, therefore, further object of the present invention to provide an image intensifier arrangement which has better capabilities of color preserving, applicable for a direct view as well as for fiber optical coupling to CCD or other imaging devices, and also an efficient and reliable method of production such a color image intensifier device without including any additional elements in the construction and with minimum difference from the known technological procedure of producing conventional colorless devices.

SUMMARY OF THE INVENTION

The problems and disadvantages of the prior art for producing and matching of input and output color filter elements of color image intensifiers is overcome by the present invention which provides an image intensifier device for producing a colored output image having an evacuated envelope with an input window for receiving an incident light image from the desirable object and an output window through which an output image is projected.

According to the present invention incident light is filtered by coloring elements of input filter incorporated into an input window in a way that provides direct optical passage of an incident light image without any transient medium to the photocathode and direct physical and optical contact of filter with photocathode without any intermediate substances. The input filter has at least two portions, the first portion passes light in the first selected range of wavelength and a the second portion passes light in a second selected range of wavelength.

The output image is colorized by the coloring elements of the output filter incorporated into an output window in a way that provides direct physical and optical contact of the filter with a phosphor screen without any intermediate substances and direct optical and physical path of filter to output of image intensifier without any intermediate substances.

The output filter has at least two portions, the first portion providing light in a first selected range of wavelength and the second portion providing light in a second selected range of wavelength.

The input and output color filters are structural colorized core glass components which together with clad glass form a vacuum tight, solid glass input and output windows, which constitute the end caps of the vacuum tube and fulfill all requirements of the intensifier tube technological process.

Input and output color filters have exact position and orientation of the coloring elements of filters within the clad glass plate, identical gross and micro-distortions in the elements itself and element arrays and oriented and aligned relative to each other so that incident light passing through the first and second portions of the input filter generates an output signal from the intensifier which is colorized by the first and second portions of the coloring element of the output filter.

The present invention also provides a method for producing the color image intensifier device in which at first disk billets for input and output windows containing input and output filters cut out form the two nearest sections of fiber optics-like an initial bar which consists of at least tow types of equal in size color core fibers enclosed in conventional clad glass. The first type of core glass is colorized by a first doping compound so that it passes light in a first selected range of wavelength and the second type of core glass is colorized by a second doping compound so that it passes light in a second selected range of wavelength.

Then cut out disk billets for input and output windows containing input and output filters shape, grain and polish, forming the input and output windows with input and output filters already incorporated in them. In a process of shaping mechanical and optical location bench marks for further identification and orientation of filters are being made. On the finished and cleaned out input window an input filter with already incorporated in it, a photocathode is then deposited in accordance with the procedure of the image intensifier producing technology.

On the finished and cleaned out output window with the output filter already incorporated in it the phosphor screen then is depositing in accordance with the procedure of the image intensifier producing technology.

The intensifier is then assembled using mechanical and optical location bench marks in such a way that input and output windows before sealing the tube are mechanically oriented and aligned relative to each other so that the coloring elements of filters in input and output color filters have such a position and orientation within the image intensifier that incident light passing through the first and second portions of the input filter generates an output signal from the intensifier which is colorized by the first and second portions of the coloring element of the output filter.

DETAILED DESCRIPTION OF THE INVENTION

The present invention relates to a color image intensifier device and includes an evacuated envelope with an input window for receiving incident light from the environment, a photocathode, deposited upon the interior surface of the envelope of the input window for converting the incident light into a photoelectron signal, a phosphor layer, emitting several wavelength approximating white light when struck by an amplified by the intensifier photoelectron signal is deposited upon an interior surface of the envelope of the output window for converting the amplified signal into a visible light output image and an output window through which an output image is projected from said intensifier.

The input filter located and integrated at the input window having means incorporated in the input window for filtering the incident light and has at list two portions. A first portion passes light in a first selected range of wavelengths and a second portion passes light in a second selected range of wavelengths. Each of two portion of the input filter subdivided into a plurality of coloring elements interspersed and distributed in a multi-beam structure as a integral part of the input window.

The output filter located and integrated in the output window having means incorporated in the output window for coloring output image and has at list two portions. A first portion provides light of first selected range of wavelengths and a second portion provides light in a second selected range range of wavelengths. The output filter is subdivided into a plurality of input filter coloring elements interspersed and distributed in a multi-beam structure as an integral part of the output window.

The output filter and the input filter are stationary with respect to the intensifier when produce output image and have a spacial alignment relative to each other. The coloring elements of first and second portions of the input filter have an approximate one-to-one correspondence with the coloring elements of the first and second portions respectively, so that incident light passing through the first and second portions of said input filter generates an output signal from intensifier which is colorized by the first and second portions, respectively, of the output filter representing the coloring of the incident light.

The coloring elements of the said input and output filters are colorized by doping glass beams distributed in the multi-beam structure incorporated into the input and output windows. The colored glass beams as colorized core glass beams have a higher coefficient of refraction and surrounded by clad glass with lesser coefficient of refraction. The colored core glass beam elements of the input and output filters together with the surrounded clad glass are forming a solid glass input and output windows which constitute the end caps of said intensifier.

The input and output windows comprise matched pairs and have an identical position and orientation of coloring elements of the input and output filters within the matched pairs of the input and output windows. The colorized core glass beam elements of the first and second portions of the input filter have a precise one-to-one correspondence with colorized core glass beam elements of the first and second portions of the output filter respectively.

The input filter coloring elements are color absorption/transmission filters in direct physical and optical contact without any intermediate substances with the photocathode and provide by direct optical passage of said incident light without any transient medium to the said photocathode. The output filter coloring elements are color absorption/transmission filters are being in direct physical and optical contact without any intermediate substances with the phosphor layer and have a direct optical and physical path to the output of the said image intensifier without any intermediate substances.

The present invention is produced by a method in which the colorized core glass beam elements and the surrounded clad glass are first drawn and fused together by glass drawing fiberoptic technology, forming a solid glass bar. The solid glass bar is then cut out having matched pairs of the input and output windows. Both input and output windows are cut out from the nearest sectors of the bar and so have an identical position and orientation of the coloring elements of the input and output filters within the matched pairs of the windows so the input filter colorized core glass beam elements of the first and second portions of the input filter have a precise one-to-one correspondence with the output filter colorized core glass beam elements of the first and second portions respectively.

The image intensifier is of the proximity focused type and the amplifying is a microchannel plate.

At least two portions of the input and output filters are three in number, the first passing red light or red light and also a first selected range of wavelength of infrared radiation or red light and also first selected range of wavelength of ultraviolet radiation, the second passing greed light or green light and also a second selected range of wavelength of infrared radiation or green light and also a second selected range of wavelength of ultraviolet radiation, the third passing blue light or blue light and also a third selected range of wavelength of infrared radiation or blue light and also a third selected range of wavelength of ultraviolet radiation.

The output image though attributable to incident light from the red or the first selected range of wavelength of infrared radiation or the first selected range of wavelength of ultraviolet radiation, the green or the second selected range of wavelength of infrared radiation or the second selected range of wavelength of ultraviolet radiation, the blue or the third selected range of wavelength of infrared radiation or the third selected range of wavelength of ultraviolet radiation, is colorized by the red, green and blue output filters respectively.

The present invention will be further described by FIGS. 1–8. This description do not intend to limit the scope of the invention but only to clarify it.

DETAIL DESCRIPTION OF THE DRAWINGS

Figure 1:
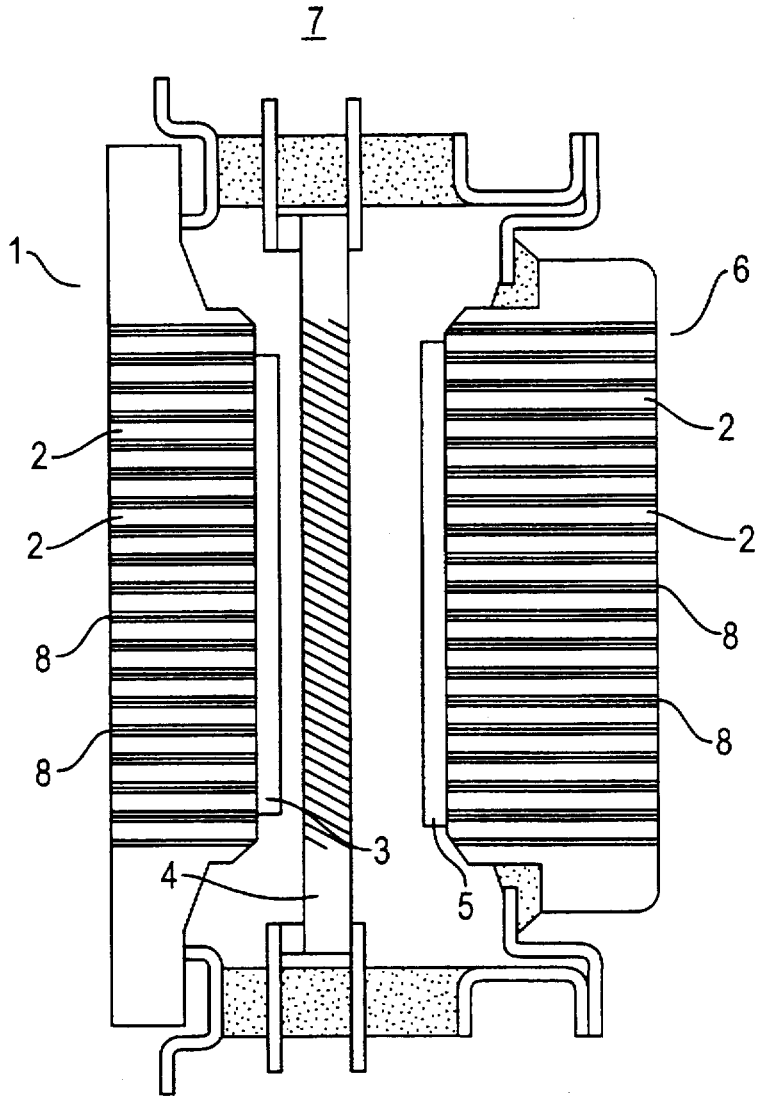
FIG. 1 illustrates a cross-sectional view of an image intensifier in accordance with the present invention, the cross-section being taken along the axis of the intensifier.

FIG. 1 illustrates a color image intensifier (7), which is capable of preserving color images. The image intensifier repeats general configuration of the "proximity focuses" image intensifier with monocolor output imaging abilities. Besides the fact that intensifiers of such a design are the most effective for producing color images in accordance with the present invention, the manufacturing of the devices in accordance with the present invention needs a minimum interference in a regular technology of conventional "proximity focused" image intensifier production. In operation incident light from an observing field of view through a frequently used focusing lens (not shown on the Figure) encounters a first and, practically, the only novel element of this invention, vis., a plurality of discrete, spaced input color filter elements (2) that pass light of selected wavelengths and absorb, or otherwise block, light of nonselected wavelengths. The filter elements (2) are incorporated in faceplate (1), function as absorption/transmission filters and can be manufactured for example from colorized glass or glass-like substances with certain optical and physical characteristics.

Despite the fact that exact mechanics of human color vision are unknown it has been determined that the response is shared by the mosaic of three different receptor elements enclosed in the retina of the eye. Each element responds to specific wavelengths corresponding to blue, green and red light and through these three elements are considerably overlapping in responsivity, each element through the nerves to the brain where the sensation of color is derived by the brain's analysis of the relative stimulus from the three elements. The full range of spectral photoresponsivity of these three elements constitute the visible part of optical spectrum.

It has been known for many years that any color can be reproduced by combinations of three typical primaries such as red, green and blue. The principle of RGB is used in the color display of TV receivers, color printing technic, etc. The input filter (1) of the present invention can utilize an RGB primary color set in two basic positions relative to each other, often called packaging, as shown on FIG. 2 and FIG. 3.

Figure 2:
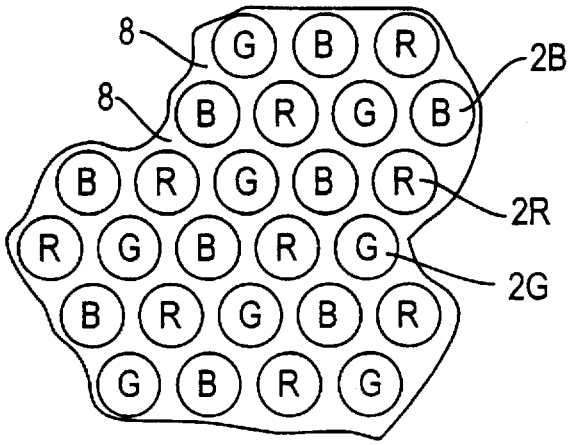
FIG. 2 and FIG. 3 illustrate a fragmental front magnified view of the input faceplate of the image intensifier of FIG. 1 showing the pattern of color filter and distribution for two basic packaging of color elements.
Figure 3:
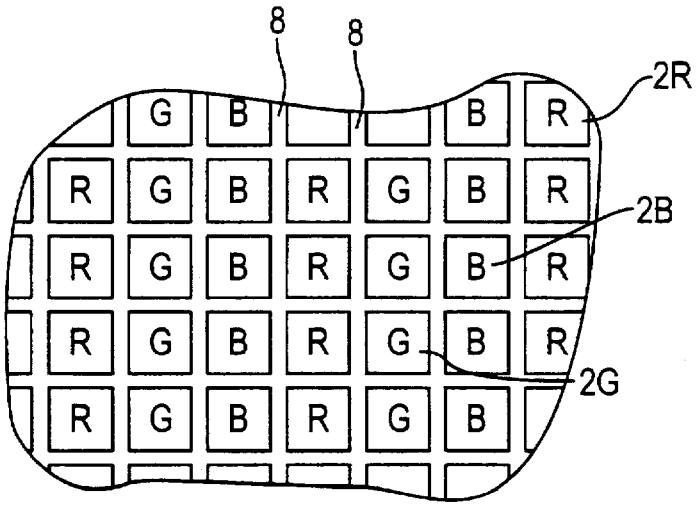

FIG. 2 and FIG. 3 illustrate fragmental front views of the faceplate (1). FIGS. 2 and 3 show the pattern of color filter (2) which is identical for input window (1) and output window (6) and is incorporated in compact glass aggregate. Each element of color set and the reference numerals are indicated by a color designator letter, i.e. R-red, G-green and B-blue.

Input and output color filters have exact position and orientation of the coloring elements of filters (2) within the clad glass (8), identical gross and micro-distortions in the elements themselves and element arrays proceeding from the technology of fabrication of plates with incorporated color filters which can be reached by using, for example, glass drawing technique as will be shown in detail below.

Referring again to FIG. 1, RGB input and output color filters are structural colorized glass beam components (2) which together with clad glass (8) are integral parts of a vacuum tight, solid glass input and output windows which constitute the end caps (1) and (6) of the vacuum tube (7) and fulfill all requirements of the intensifier tube technological process. The coefficient of refraction of color glass elements (2) is less than the coefficient of refraction of clad glass (8) and correlation of the coefficient is such that theoretical numerical aperture is equal or close to unity and elements (2) and clad glass (8) form fiberoptics-like structure.

The glass, from which color elements (2) and clad component (8) are manufacture, are very stable physically, chemically and electrically and are insensitive to the external environment, the photocathode (3) and electrical activity of the intensifier tube (7). In that way colorized glass beam components (2) do not require any protective coating in the inner as well as the outer sides of the faceplate (1) and backplate (6). Nevertheless, in case of need, transparent protective filming of the inner surface of faceplate (1) and backplate (6) can be used.

Incident light falling on the outer side of faceplate (1) in the process of transferring by colorized glass beam components (2), which acts as a coherent light guide, is analyzing by the same components (2), which acts at the same time as a multi-element filter, that passes light of selected wavelengths and absorbs, or otherwise blocks, light of nonselected wavelength, then strikes the photocathode (3), which emitted the photo electrons in proportion to the magnitude of the incident light. After emission, photo electrons are accelerated by passage through high field spacings between photocathode (3) and microchannel plate (4), hit microchannel plate (4) which amplifies the electron signal. Although a microchannel plate (4) is used to amplify the photo electron signal in the intensifier shown on on Figure any other known methods means of amplifying the signal can be used. An amplified flux of electrons from the output of microchannel plate (4) is accelerated by passage through another high field spacing and hits a white phosphor screen (5) deposited upon an output window (6) with output color filter elements (2).

The phosphor layer (5) is fluorescing white light as a result of collision of accelerated electrons into it. Fluorescing white light radiation consists of several wavelength or ranges of wavelength including R, G and B parts of spectrum. White light is analyzed into RGB basic colors and transmitted to exit as was described above, by an output color multi-element filter in backplate (6), which is color-matched and precisely and spacially aligned with an input color multi-element filter in faceplate (1) in a such a way that output image is appropriately colorized.

Figure 6:
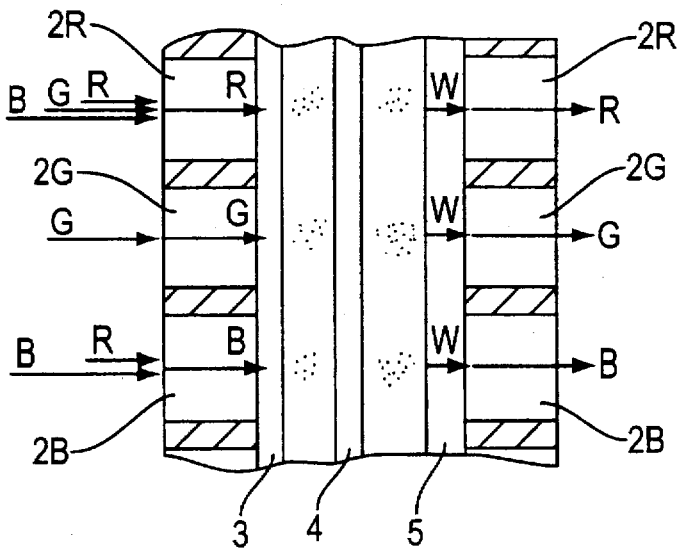
FIG. 6 illustrates a diagrammatic, cross-section view of an image intensifier as shown in FIGS. 1 and 2 in operation.

A more detailed description of the operation of image intensifiers (7) can be received by referring to FIG. 6. In FIG. 6, incident light radiation from the the visible part of the spectrum consisting of red, green and blue components is represented by arrows labelled R(ed, G(reen) and B(lue). The rays of RGB colors hit colored glass beam component 2R. The color component 2R passes the red rays R and blocks G(reen) and B(lue) rays, color component 2G passes accordingly G light and the 2B element blocks the R light. When the green light passes through the green filter 2G and hits the photocathode (3), it causes the emission of photoelectrons which are accelerated to and amplified by microchannel plate (4). An amplified signal collides into the phosphor element (5), which has been selected to emit white light labelled W(hite). White light being colored green while travels through the output color filter elements 2G to correspond to the color of the incident light and the signal generated and amplified as a result of green light passing through 2G is colored green by 2G upon leaving the intensifier. The red portion of mixed red, green and blue rays is shown passing through 2R, thereafter being converted to an electron signal, amplified, reconverted to white light, transferring and simultaneously colorized red by a red output beam elements 2R. A red incident light ray hitting the 2B is depicted as being blocked by filter 2B, whereas a blue light is permitted to pass through and initiate the above described light amplification and recolorization.

Components 2R, 2G and 2B in output filter (6) is positioned exactly in front of the amplified electron signal from the photocathode sections covering the 2R, 2G and 2B colored glass beam component of the input filter. This is true for all the pixels of each color.

It may appear that the color preservation abilities of the present invention is depended only on the accuracy of alignment components 2R, 2G and 2B of the input filter and the 2R, 2G and 2B components of the output filter and the simplest expedient for obtaining this condition is to create a duplicate pair of filmed filter grids, i.e. one for input and one for output. This in combination with an adjustable faceplate which permits moving one of the filter grids relative to the other that would allow repeating patterns to be aligned interactively as the tube is operated. This solution does not provide maximal alignment, however, in those instances where an intensifier tube may, for example, distort the spacing between the color pixels at the output plane from that, which appears on the input plane. This difficulty may be surmounted by a method of forming the grid of output filter elements from photosensitive coloring materials, employing in the capacity of referent marks for positioning of output filter elements the signals form the grid of input filter elements as it appears on the actual output of the particular tube with individual characteristics. In spite of the fact that this method avoids some of the filter misalignment problems for example, gross distorting and inverting, inherent to electrostatic focused tubes there are, however, certain limitations to tube performance, construction and manufacturing which are suggesting against this strategy.

Namely, the size of color elements and density of its distribution upon a grid pattern of even modest resolution are comparable to the size of separate fibers and its density in the fiberoptic windows of the image intensifier which makes color preservation dependable on fiberoptics. In the case of a tube which includes an input color multi-element filter, which is sandwiched between the faceplate and photocathode, and output fiberoptical window alignment of input and output color filters will be based on efficiency of matching of input color filter with output fiberoptic plate. But alignment of input color filter with, even gross- and shear-distortion free output fiberoptic element, limits the resolution of the image intensifier tube in such a way that color separation of color multi-element filter with appropriate resolution is not possible, because of micro-distortions in the fibers and fiber-optic array and, more important, exact position and orientation of elements of the input filter and the fiber components within the fiberoptics array cannot be adjusted relative to each other during fabrication and the resulting quality of the image from the cascaded input color multi-element filter and output fiberoptics cannot be known until a system has been fabricated. In that way, this method spoils imaging abilities of the color preserving image intensifier and, in particular, reduces the density of the distribution of coloring elements of the output color filter upon a grid pattern. Furthermore, positioning of the input color filter in proximity to the inner surface of the input window demands protection of it from photocathode activity by transparent glass coating. Transparent protective coating, which is actually a substrate with certain thickness for color filter elements deposition, disturbs direct optical contact between the color filter and photocathode proportional to the thickness of the coating and as result of it, reduces resolution of an image intensifier. In addition the multi-refection in multilayered structure faceplate-filter-glass protective coating reduces input window transparency and therefore sensitivity of all devices which, taking into consideration the low level of input light, negatively influences the noise level.

Except for additional operations of inclosing and protection of the input color filter there are more than a dozen serial operations for producing red, green and blue elements of output external filters by means of dispensing, exposure, wet developing and fixing of photosensitive coloring materials which also is not an advantage of this method. A preferred method for the production of a color preserving image intensifier in accordance with the present invention avoids the problem of reducing the resolution of color multi-element filters posed by pure matching of an input color filter with output fiberoptics inherent in conventional tubes, escapes the reducing of transparency of the faceplate window because it does not demand the protection of an input color filter, does not require any additional construction details to the conventional image intensifier tube and additions to conventional operations or technological processes as well.

Figure 4:
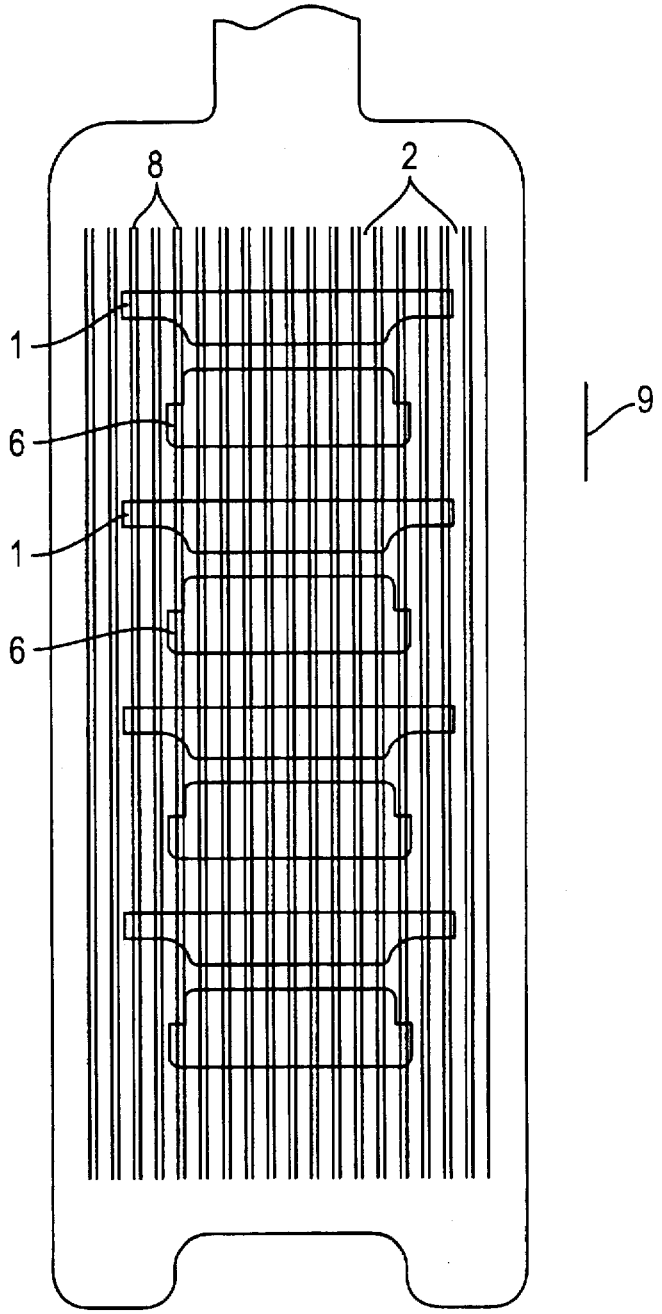
FIG. 4 illustrates a diagram illustrating the preparation of the input and output windows with includes in it color filters for an image intensifier in accordance with the present invention method. The diagram is a cross-sectional view of packaging of color elements forming color filter in an initial glass bar, the cross-section being taken along the axis of the bar.

This approach by employing the method of forming the matrix of input and output color filter elements that is based upon the conventional glass drawing technology. FIG. 4 shows the initial glass bar (9) from which pairs of input and output plates (1) and (6) including R(ed) G(reen) B(lue) (therein after called RGB) color elements (2) of input and output filters are sliced. Initial glass bar (9) consists of long contemporary RGB colored glass beams (2) surrounded by the clad glass with lessor coefficient of refraction (6) and fused together with it into solid glass mould (9). Colored RGB elements are positioned relatively to each other as is shown in FIG. 2 or FIG. 3 which reveal a cross-sectional view of a glass bar (9). Fabrication of a solid glass bar (9) employs the well known fiberoptics or microchannel plate technology where elements 2R, 2G and 2B of structure shown in FIG. 2 and (3) are formed by packaging and fusing at first a hexagonal or square array from RGB colored core glazing molds in clad envelopes in an amount small enough to be positioned easily into the needed order relative to each other. The first array is then itself drawn down, cut into sections, assembled and fused in the needed arrays and drawn again until the individual core elements are of the required pixels 2R, 2G and 2B of the color filter size. As clad glass (8) uses conventional clad glass for fiberoptical technology, so colored RGB core glass uses core glass for fiberoptics technology but colorized by inorganic coloring materials such as for example oxides of metals CuO for 2R, $K_2Cr_3O_7$ 2G and CoO for 2B filter elements. Color glass based on these material are simple color absorption filters with spectral transparency defined by concentration of coloring doping and are stable to photocathode and electrical activity of inner volume of an image intensifier tube. Referring again to FIG. 4, the pairs of input and output windows (1) and (6) are sliced from the nearest sectors of bar (9), in order to have absolutely identical position end orientation of the RGB elements within the RGB glass array and to keep identify of the RGB patterns of color elements of input and output filters up to gross and micro-distortions of the RGB elements and of its arrays in such a way that makes possible distortion free cascaded coupling of input and output RGB filters. After shaping, graining and polishing in accordance with the procedure of producing conventional fiber optical windows, the matched pairs of plates form the matched pairs of faceplate and backplate windows shaped in the Figure as (1*a*) and (6*a*) or (1*b*) and (6*b*).

Alignment of input and output color multi-element filters is implemented in the course of the regular procedure of image intensifier manufacturing. Referring to FIG. 1, after the processing of photocathode (3) on the faceplate (1) and coupling it to the tube (but before sealing the tube) alignment is implemented by means of the precision adjusting of movable faceplate (1) relatively of an immovable, operating, though not sealed, tube under visual control of magnified output image from back plate (6) using semitransparent or nontransparent directing optical bench marks incorporating into faceplate (1) and identical marks incorporating into backplate (6) (not shown on the Figures). Shifting and rotation of the faceplate (1) with the input color filter until mark points in input and its matching mark points in output overlap each other on the output screen provides the approximate-correct position. Afterwards sharp adjustment proceeds under monochromatic illumination by one of the R, G and B colors on the photocathode, until in the correct position all chromatic moire vanish and in the field of vision (with more powerful magnification) the correct monochromatic flat-field response will appear and the image intensifier tube can be sealed. While an adjustment of faceplate (1) in an operating tube under visual control of backplate (6) is used to align colored glass beam elements (2) of input and output color filters, any other known means of alignment can be used, for example providing faceplate (1) or backplate (6) or both with lugs, teeth or other indexing means which allows the precisely reproducible registration of the faceplate or back plate or both with the tube in such a way that a matrix of input color filter elements (2) in faceplate (1) are color-matched and spatially aligned with the matrix of output color filter elements (2) in back plate (6) within an image intensifier tube.

Figure 5:
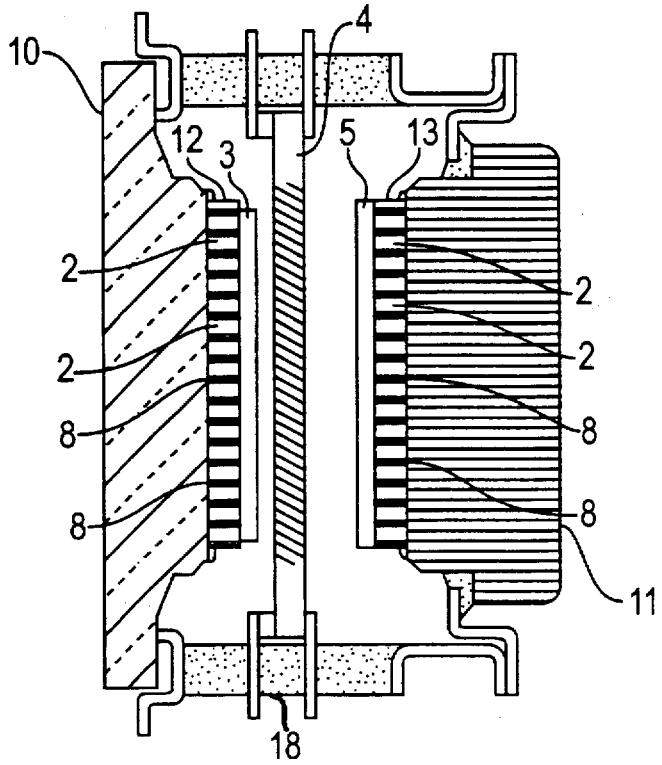
FIG. 5 illustrates a cross-sectional view of an image intensifier in accordance with a second embodiment, the cross-section being taken along the axis of the intensifier.

FIG. 5 shows image intensifier (16) which is capable of preserving color images and represents a second embodiment of the present invention. The image intensifier repeats the general scheme of the image intensifier device (7) from FIG. 1, but in this case input color filter (12) and output color filter (13) are not structural part of the input and output windows of a tube but bonded to internal surfaces of windows. Input color filter (12) consists of colored glass beam elements (2) which together with clad glass (8) form glass wafer plate and are very stable physically, chemically and electrically and serve as a substrate for photocathode (3). Analogically, output color filter (13) consists of colored glass beam element (2) which together with clad glass (8) form a glass wafer-plate and are very stable physically, chemically and electrically and serve as a substrate for phosphor layer (5). The input faceplate (10) is transparent to light of various wavelengths. After passing through faceplate (10), the incident light encounters the elements (2) of input color filter (12) that pass the light of a selected wavelength and absorb or otherwise block light of nonselected wavelength. Light passes color filter (12) and strikes photocathode (3), which in response thereto emits photo electrons which being accelerating in high field spacings and amplifying on microchannel plate (4), hit the white phosphor layer (5) which in response fluoresces white light radiation. The white glow of the phosphor is passed through a matrix of color beam glass elements of output color filter (13) which are color matched and spatially aligned with the elements of input color filter (12). An appropriately colored output image is then transmitted through the fiberoptics of output window (11) to exit an image intensifier. In Figure input and output color filters (12) are shown in positions that proximate faceplate (10) but can be fixed in such a way so as to retain a certain distance between faceplate (10) and filter (12).

Figure 7:
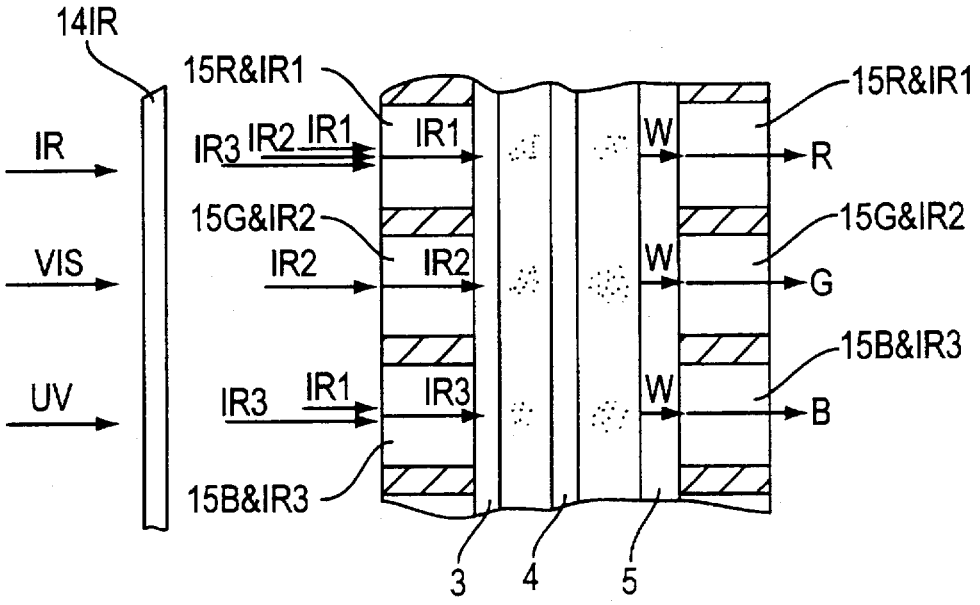
FIG. 7 illustrates a diagrammatic, cross-sectional view of an image intensifier for converting the infrared image into pseudo color image in accordance with a third embodiment of the present invention in operation.
Figure 8:
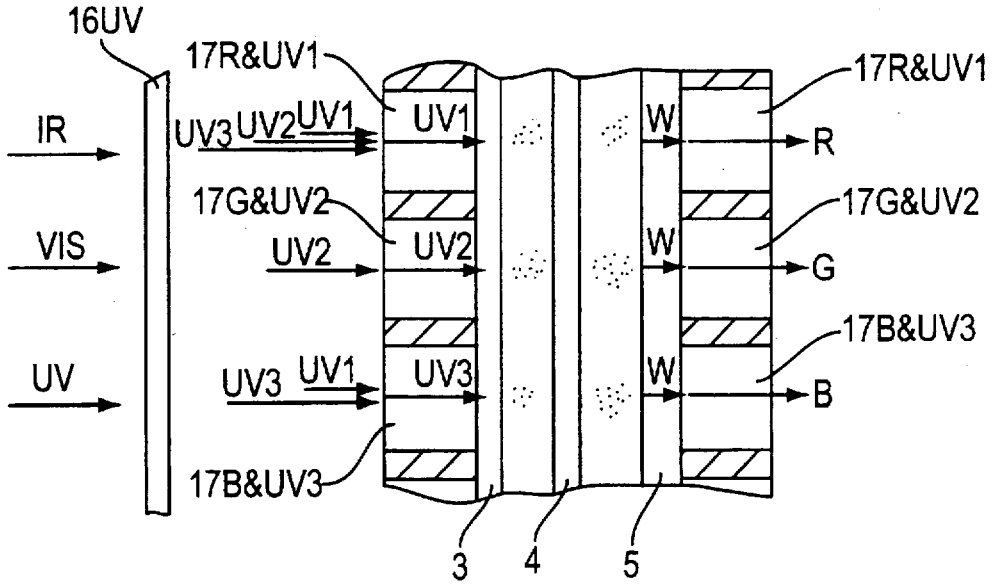
FIG. 8 illustrates a diagrammatic, cross-sectional view of an image intensifier for converting the ultraviolet image into pseudo color image in accordance with a third embodiment of the present invention in operation.

FIG. 7 illustrates the third embodiment of the present invention, intended for representation of weak infrared images by an intensified pseudo color image, wherein white phosphor and an output filter are utilized as in previous embodiments but colored glass beam elements of input and output filters are different from other embodiment transparency. Element 15R&IR1 passes R(ed) light and also a first selected range of wavelengths of infrared radiation labelled IR1, element 15G&IR2 passes G(reen) light and also a second selected range of wavelengths of infrared radiation labelled IR2, and element B&IR3 passes B(lue) light and a third selected range of wavelengths of infrared radiation labelled as IR3. In FIG. 7, pass filter 14IR passes light of only infrared radiation and blocks visible light. The rays of IR1, IR2 and IR3 portions of the radiation hit the colored glass beam component 15R&IR1, which passes rays IR1 and blocks IR2 and IR3 rays, color component 15G&IR2 passes accordingly IR2 light and the 15B&IR3 element blocks the IR1 rays and passes IR3 light. The selected infrared signals are amplified and converted into white light signals, proportional to the power of incident radiation. The output filters 15R&IR1, 15R&IR2 and 15R&IR3 in this case simply pass R, G and B light correspondingly, exactly as RGB elements of the output filter in previous embodiments. In that way rad color is selected to represent IR1 radiation, green color represent IR2 radiation and blue color represent IR3 radiation in the output of the image intensifier. FIG. 5 whose the variant of the same embodiment but is intended for representation of weak ultraviolet images by an intensified pseudo color image. Pass filter 17UV blocks visible and infrared light and 17R&UV1, 17R&UV2 and 17R&UV3 element so input filter pass correspondingly UV1, UV2 and UV3 ultraviolet radiation which is represented in output by red, green and blue colors. In the preparation of this embodiment, a glass drawing technique is used as in the first embodiment, but spectral transparency of the color R(ed), G(reen) and B(lue) core glass beams (2) shown in FIG. 4, would be broadened in such a way as to allow light to pass in corresponding IR1, IR2 and IR3 selected ranges of infrared radiation or in UV1, UV2 and UV3 ranges in cases where the invention is to represent ultraviolet images. This is accomplished by using the proper core glass and proper doping by a certain concentration of coloring nonorganic composition stable to photocathode and electrical activity of the inner volume of the image intensifier tube. Further operations are the same as those represented in the description of FIG. 4.

The present invention except color preserving abilities and visualization of infrared and ultraviolet images allows representation of some radiation from electro-magnetic spectrum actinic for microchannel plate (4), FIG. 1, by pseudo colors.

I claim:

1. A color image intensifier device for producing a colored output image, comprising:

(a) an evacuated envelope having an input window for receiving incident light from the environment into said image intensifier and an output window through which an output image is projected from said intensifier;

(b) input filter located and integrated at the input window having means incorporated in said input window for filtering said incident light, a first portion of said input filter having means for passing red light, a second portion having means for passing green light and a third portion having means for passing blue light, said means for filtering the incident light, each subdivided into a plurality of input filter coloring elements interspersed and distributed in a multi-beam structure as an integral part of said input window;

(c) output filter located and integrated at the output window having means incorporated in said output window output filter having means for providing red light, a second portion having means for providing green light and a third portion having means for providing blue light, said means for providing red, green and blue light each subdivided into a plurality of input filter coloring elements interspersed and distributed in a multi-beam structure as an integral part of the output window, the output filter and input filter being stationary with respect to the intensifier when producing the output image and having a spacial alignment relative to each other, the input filter coloring elements of said first, second and third portions having an approximate one-to-one correspondence with the output filter coloring elements of the said first, second and third portions respectively, so that incident light passing through the the first, second and third portions of the input filter means generates an output signal from said intensifier which is colorized by said first, second and third portions, respectively, of the output filter means to represent the coloring of the the incident light, wherein the means for filtering the incident light and coloring the output image—are coloring elements of the input and the output filters colorized by doping glass beams distributed in the said multi-beam structure incorporated in the input and output windows, said colored glass beams being colorized core glass beams means—having higher coefficient of refraction being surrounded by clad glass means with lesser coefficient of refraction, and wherein the said colored core glass beam elements of the input filter and the output filters being one of the structural constituent part forming of the input and the output windows, and the surrounded clad glass being second structural integral part of the input and the output windows, comprising the solid glass input and output windows, constituting the end caps of said intensifier, and the input and the output windows being matched pairs means—having an identical position and orientation of said coloring elements of said input and said output filters within said matched pairs of said input and said output windows means—said input filter colorized core glass beam elements of the first, second and third portions of the input filter means having a precise one-to-one correspondence with the output filter colorized core glass beam elements of said first, second and third portions respectively;

(d) a photocathode deposited upon the interior surface of the envelope of the input window for converting the incident light passing through the input window—into a photoelectron signal, and having amplifying—means for amplifying the photoelectron signal and reconverting means for converting the amplified signal into a visible light output image, and the said reconverting means being a phosphor layer deposited upon an interior surface of the envelope of the output window and the phosphor layer emitting several wavelength of light in the visible region when struck by said amplified signal, said light of several wavelength approximating white light and propagating through the coloring elements of the output filter, and the output image being colorized.

2. A color image intensifier device according to claim 1, wherein the input filter coloring elements and the output filter coloring elements—are color absorption/transmission filters.

3. A color image intensifier device according to claim 1, wherein the input filter coloring elements are in direct physical and optical contact with the photocathode without any intermediate substances.

4. A color image intensifier device according to claim 1, wherein the output filter coloring elements are in direct physical and optical contact with the the phosphor layer without any intermediate substances.

5. A color image intensifier device according to claim 1, wherein the the input filter coloring elements are provided by direct optical passage of the incident light without any transient medium to the the photocathode and the output filter coloring elements are in a direct optical and physical path to the output of the the image intensifier without any intermediate substances.

6. A color image intensifier device according to claim 1, wherein the colorized core glass beam elements and the surrounded clad glass are drawn and fused together, as in the conventional glass drawing fiberoptic technology, forming a solid glass bar being cut out having said input and output windows, constituting the end caps of the intensifier, both the input and output windows being cut out from the nearest sectors of the same bar comprising matched pairs having an identical position and orientation of the coloring elements of the input and the output filters within the matched pairs of the input and the output windows and the input filter colorized core glass beam elements of the first, second and third portions of the input filter having a precise one-to-one correspondence with the output filter colorized core glass beam elements of the first, second and third portions respectively.

7. A color image intensifier device according to claim 1, wherein the image intensifier is of the proximity focused type and the the amplifying means if a microchannel plate.

8. A color image intensifier device for producing a colored output image, comprising:

(a) an evacuated envelope having an input window for receiving incident light from the environment into the said image intensifier and an output window through which an output image is projected from the said intensifier;

(b) input filter located inside the evacuated envelope having means affixed proximate to the said input window for filtering the incident light, the first portion of the said input filter having means for passing red light, the second portion having means for passing green light and the third portion having means for passing blue light, and said means for filtering the incident light each subdivided into a plurality of input filter coloring elements interspersed and distributed in a multi-beam plate structure parallel to the input window;

(c) output filter located inside the evacuated envelope having means affixed proximate to said input window for coloring the output image the first portion of said output filter having means for providing red light, the second portion having means for providing green light and the third portion having means for providing blue light, and said means for providing red, green and blue light each subdivided into a plurality of input filter coloring elements interspersed and distributed in a multi-beam plate structure parallel to the input window and the output filter means and the input filter means being stationary with respect to the intensifier when producing the output image and having a spacial alignment relative to each other, the input filter coloring elements of said first, second and third portions of the input filter having an approximate one-to-one correspondence with the output filter coloring elements of said first, second and third portions respectively, so that incident light passes through the first, second and third portions of the input filter generates an output signal from said intensifier which is colorized by the first, second and third portions, respectively, of the output filter means to represent the coloring of the incident light, wherein the means for filtering the incident light and coloring the output image—are coloring elements of the input and the output filters—colorized by doping glass beams distributed in said multi-beam structure, said colored glass beams being colorized core glass beams means having higher coefficient of refraction being surrounded by clad glass means with lesser coefficient of refraction, and the colored core glass beam elements of the input filter and the output filters being one of the structural integral parts forming said input and said output filter plates, and said surrounded clad glass being second structural integral part of the input and the output filter plates, and are drawn and fused together, as in the conventional glass drawing fiberoptic technology, forming a solid glass bar being cut out having an input and output filter plates, both said input and output filter plates being sliced out from the nearest sectors of the same bar comprising matched pairs means—having an identical position and orientation of the coloring elements of the input and the output filters within the matched pairs of the input and the output filter plates means the input filter colored core glass beam elements of the first, second and third portions of said input filter having a precise one-to-one correspondence with said output filter colored core glass beam elements of said first, second and third portions respectively;

(d) a photocathode located in the envelope for converting the incident light passing through the input window and having amplifying means for amplifying the photoelectron signal and reconverting means for converting the amplified signal into a visible light output image, and the reconverting means being a phosphor layer contained upon an interior surface of the envelope of the output window, the output filter coloring elements being color absorption/transmission filters and means being in direct physical and optical contact with the phosphor layer without any intermediate substances, and the output filters incorporated in the output filter plate and sandwiched between and bonded with the output window and the phosphor layer, and the phosphor layer emitting several wavelengths of light in the visible region when struck by said amplified signal, the light of several wavelengths approximating white light and propagating through the coloring elements of the output filter, and the output image being colorized, said input filter coloring elements being color absorption/transmission filters and being in direct physical and optical contact with the photocathode without any intermediate substances, the input filters incorporated in the input filter plate and sandwiched between and bonded with the input window and the photocathode.

9. A color image intensifier device according to claim 8, wherein the output window is composed of fiber optic elements.

10. A color image intensifier device according to claim 8, wherein the the image intensifier is of the proximity focused type and the the amplifying means if a microchannel plate.

11. A color image intensifier device for producing a colored output image, comprising:

(a) an evacuated envelope having an input window for receiving incident light from the environment into said image intensifier and an output window through which an output image is projected from said intensifier;

(b) input filter located and integrated at the input window having means incorporated in said input window for filtering said incident light, a first of at least two portions of said input filter having means for passing light in a first selected range of wavelengths and a second portion having means for passing light in a second selected range of wave-lengths, said at least two portions of said means for filtering the incident light each subdivided into a plurality of input filter coloring elements interspersed and distributed in a multi-beam structure as integral part of said input window;

(c) output filter located and integrated at the output window having means incorporated in said output window for coloring said output image a first of at least two portions of said output filter having means for providing light of one selected range of wavelengths and a second portion having means for providing light in a second selected range, said at least two portions of output filter means each subdivided into a plurality of input filter coloring elements interspersed and distributed in a multi-beam structure as an integral part of the output window, the output filter and input filter means being stationary with respect to the intensifier when producing the output image and having a spacial alignment relative to each other, the input filter coloring elements of said first portion means having an approximate one-to-one correspondence with the output filter coloring elements of said first portion of said output filter and input filter coloring elements of said second portion portion of said input filter means having an approximate one-to-one correspondence with said output filter coloring elements of said second portion of said output filter, so that incident light passing through the first and second portions of the input filter means generates an output signal from said intensifier which is colorized by said first and second portions, respectively, of the output filter means to represent the coloring of the incident light, wherein the means for filtering the incident light and coloring the output image—are coloring elements of the input and the output filters—colorized by doping glass beams distributed in the said multi-beam structure, incorporated in the input and output windows, said colored glass beams being colored core glass beams means having higher coefficient of refraction being surrounded by clad glass means with lesser coefficient of refraction, and wherein the said colored core glass beam elements of the input filter and the output filters being one of the structural constituent parts forming the input and the output filters, and the surrounded clad glass being a second structural integral part of the input and the output filters, and are drawn and fused together, as in the conventional glass drawing fiberoptic technology, forming a solid glass bar being cut out having an input and the output filters, constituting the end caps of said intensifier, both said input and said output filters being cutting out from the nearest sectors of the same bar comprising matched pairs means having identical position and orientation of the coloring elements of the input and the output filters within the matched pairs of the input and the output windows means—the input filter colored core glass beam elements of the first and second portions of said input filter means having a precise one-to-one correspondence with the output filter colored core glass beam elements of said first and second portions respectively, (d) a photocathode deposited upon the interior surface of the envelope of the input window for converting the incident light passing through the input window into a photoelectron signal, and amplifying having means for amplifying the photoelectron signal and reconverting means for converting the amplified signal into a visible light output image, and the said reconverting means being a phosphor layer deposited upon an interior surface of the envelope of the output window, the output filter coloring elements being color absorption/transmission filters, and the phosphor layer emitting several wavelengths of light in the visible region when struck by said amplified signal, said light of several wavelengths approximating white light and propagating through the coloring elements of the output filter, the output image being colorized, and the input filter coloring elements being color absorption/transmission filters.

12. A color image intensifier device according to claim 11, wherein further including a removable separate filter positioned proximate to said input window for filtering the incident light, the separate filter passing only light of selected wavelength so that only infrared information is depicted in the incident light, and wherein said at least two portions of the input filter means are three in number, the first passing red light and also a first selected range of wavelength of infrared radiation, the second passing green light and also a second selected range of wavelength of infrared radiation and the third passing blue light and also a third selected range of wavelength of infrared radiation, and wherein said at least to portions of the output filter means are three in number, the first passing red light and also a first selected range of wavelength of infrared radiation, the second passing green light and also a second selected range of wavelength of infrared radiation and the third passing blue light and also a third selected range of wavelength of infrared radiation, so that the output image attributable to incident light from the first selected range of wavelength of infrared radiation, the second selected range of wavelength of infrared radiation and the third selected range of wavelength of infrared radiation is colorized by red, green and blue output filters respectively.

13. A color image intensifier device according to claim 12, wherein said removable separate infrared filter positioned proximate the input window for filtering the incident light, replaced by removable separate ultraviolet filter positioned proximate to the input window for filtering the incident light, the separate filter passing only light of selected wavelengths to such an extent that only ultraviolet information is depicted in the incident light, and wherein at least two portions of the input filter means are three in number, a first passing red light and also a first selected range of wavelength of ultraviolet radiation, a second passing green light and also a second selected range of wavelength of ultraviolet radiation and a third passing blue light and also a third selected range of wavelength of ultraviolet radiation, and wherein said at least two portions of said output filter means are three in number, a first passing red light and also a first selected range of wavelength of ultraviolet radiation, a second passing green light and also a second selected range of wavelength of ultraviolet radiation and a third passing blue light and also a third selected range of wavelength of ultraviolet radiation, so that the said output image attributable to incident light from the first selected range of wavelength of ultraviolet radiation, the second selected range of wavelength of ultra-violet radiation and the third selected range of wavelength of ultraviolet radiation is colorized by red, green and blue output filters respectively.

* * * * *